US008480359B2

(12) United States Patent
Pan

(10) Patent No.: US 8,480,359 B2
(45) Date of Patent: Jul. 9, 2013

(54) BLOWER

(75) Inventor: Erjian Pan, Foshan (CN)

(73) Assignee: Foshan Shunde Xinshengyuan Electrical Appliances Co. Ltd. (CN)

( * ) Notice: Subject to any disclaimer, the term of this patent is extended or adjusted under 35 U.S.C. 154(b) by 800 days.

(21) Appl. No.: 12/701,652

(22) Filed: Feb. 8, 2010

(65) Prior Publication Data

US 2011/0027078 A1 Feb. 3, 2011

(30) Foreign Application Priority Data

Jul. 31, 2009 (CN) ..... 2009 2 0061616 U

(51) Int. Cl.
*F04D 29/44* (2006.01)

(52) U.S. Cl.
USPC ..... 415/204; 415/206

(58) Field of Classification Search
USPC ..... 415/206, 204, 121.2, 169.2; 417/366, 417/371, 423.11, 423.14; 277/630, 637
See application file for complete search history.

(56) References Cited

U.S. PATENT DOCUMENTS

| | | | | |
|---|---|---|---|---|
| 2,686,630 | A * | 8/1954 | Burrowes | 417/352 |
| 3,818,600 | A | 6/1974 | Fischer | |
| 5,951,241 | A * | 9/1999 | Dahlheimer | 415/55.4 |
| 6,422,808 | B1 * | 7/2002 | Moss et al. | 415/55.1 |
| 6,997,687 | B2 * | 2/2006 | Iritani | 417/371 |
| 2006/0093500 | A1 | 5/2006 | Liang et al. | |
| 2008/0292455 | A1 * | 11/2008 | Glore et al. | 415/204 |
| 2009/0274551 | A1 * | 11/2009 | Messmer | 415/148 |
| 2010/0322792 | A1 * | 12/2010 | Liang | 417/321 |

FOREIGN PATENT DOCUMENTS

| | | | |
|---|---|---|---|
| CH | 201401366 | * | 2/2010 |
| CN | 200520067248.6 | | 1/2001 |
| CN | 2656682 | | 7/2009 |
| CN | 201401366 | | 2/2010 |
| JP | 2006014786 | | 1/2006 |

OTHER PUBLICATIONS

Written Opinion; PCT/CN2010/071065; Int'l File Date: Mar. 16, 2010; Foshan Shunde Xinshengyuan Electrical Appliances Co., Ltd.; English translation of p. 4.

International Search Report; PCT/CN2010/071065; Int'l File Date: Mar. 16, 2010; Foshan Shunde Xinshengyuan Electrical Appliances Co., Ltd.; 6 pages.

* cited by examiner

*Primary Examiner* — Edward Look
*Assistant Examiner* — William Grigos
(74) *Attorney, Agent, or Firm* — Schmeiser, Olsen & Watts LLP

(57) ABSTRACT

A blower comprising: a snail-shaped base, a snail-shaped cover, blades and a motor, wherein the snail-shaped base and the snail-shaped cover form a exhaust channel, the blades are horizontally provided in the exhaust channel, the snail-shaped cover above the blades is provided with an air intake channel formed by a motor mounting chamber and a motor cover, and the motor is vertically disposed in the air intake channel and connected to the blades therebelow. The blower is structurally scientific and concise. When the blower operates, air is taken in and provides effective heat dissipation for the motor, and there is a sufficient distance between the motor and the ground surface, and waterproof designs of the sealed capacitor junction box and both ends of the motor can perform an excellent waterproof function.

8 Claims, 14 Drawing Sheets

BLOWER

FIELD OF THE INVENTION

The present invention relates to a blower.

BACKGROUND OF THE INVENTION

The prior-art blowers are mostly in vertical orientation, that is, its blades are vertically disposed. The prior-art blowers are constructed to comprise a motor, blades, and a exhaust channel, wherein the blades are vertically mounted in the channel in a way that a rotation surface of the blades is vertical, and the motor is mounted on the other side of the channel. Since the blower employs a vertical construction, the unbalance of weight of the motor and the blades is liable to cause deflection of center of gravity so that the blower cannot be placed stably and stable operation and service life of the blower are affected. On the other hand, the motor is not disposed in the air intake channel, and heat dissipation mainly depends on small-sized heat dissipating blades at the tail of the motor, which leads to an undesirable heat dissipating effect and a large energy consumption. The Chinese Patent CN200520067248.6 discloses a horizontal type blower which solves the problems such as deflection of center of gravity and unstable operation of the blower. However, since in the technical solution of the forgoing patent the motor of the blower is disposed below a base of a wind channel, closer to the ground surface and since the blower operates outdoors in most cases, the motor of the blower is more likely to be submerged by rain water on rainy days, thereby causing malfunction or hidden hazards.

SUMMARY OF THE INVENTION

In view of the problems and drawbacks, an object of the present invention is provide a blower which exhibits safe use, stable operation and placement, and long service life.

To achieve the above object, the present invention employs the following technical solution:

A blower comprises a snail-shaped base, a snail-shaped cover, blades and a motor, wherein the snail-shaped base and the snail-shaped cover form a exhaust channel, the blades are horizontally provided in the exhaust channel, the snail-shaped cover above the blades is provided with an air intake channel formed by a motor mounting chamber and a motor cover, and the motor is vertically disposed in the air intake channel and connected to the blades therebelow.

A plurality of slit-shaped air intake ports are provided on a sidewall of the motor cover.

To reinforce resistance against water, the motor cover is provided with a ring of waterproof rib on which an annular waterproof sponge is mounted; a water baffle is provided between the motor and the blades.

On the snail-shaped cover are provided a sealed capacitor junction box which is formed by sealingly engaging a capacitor junction cavity with a capacitor junction lid.

A switch is provided on the capacitor junction lid, and a waterproof seal switch sleeve is provided between the switch and the capacitor junction lid.

The blower according to the present invention is structurally scientific and concise; the blades are horizontally disposed; the motor is vertically disposed above the blades in the air intake channel so that, on the one hand, when the blower operates, air is taken in and meanwhile provides effective heat dissipation for the motor, and on the other hand, there is a sufficient distance between the motor and the ground surface, and waterproof designs of the sealed capacitor junction box and both ends of the motor can perform an excellent waterproof function and avoid dangers from submergence of water. The blower according to the present invention is novelly designed, energy-saving, environment-friendly, safe for use, stable in placement and operations and long-service life.

In the figures, the reference number 1 denotes motor cover; 2 waterproof sponge; 3 motor; 4 snail-shaped cover; 5 spout net; 6 snail-shaped base; 7 blades; 8 capacitor junction box; 9 switch; 10 switch press plate; 11 slit-shaped air intake ports; 12 handle; 13 waterproof rib; 31 front end cover; 32 rear end cover; 41 motor mounting chamber; 42 motor mounting leg; 43 waterproof ring wall; 44 spigot flange; 51 stainless steel net; 52 spout net sleeve; 61 leg support; 62 spigot slot; 81 capacitor junction lid; 82 capacitor junction cavity; 83 capacitor; 84 power line sleeve; 85 waterproof seal switch sleeve; 86 switch guard cover; 100 water baffle; 101 ventilation opening; 102 ventilation opening ring; 500 elliptical spout net mounting groove; 611 ground nail mounting hole; 811 sealing slot; 812 switch sleeve sealing rib; 813 motor lead wire through hole; 821 sealing rib; 822 power line notch.

The present invention will be further described with reference to the accompanying drawings and preferred embodiments.

DETAILED DESCRIPTION OF THE PREFERRED EMBODIMENTS

Embodiment 1

Figure 1:
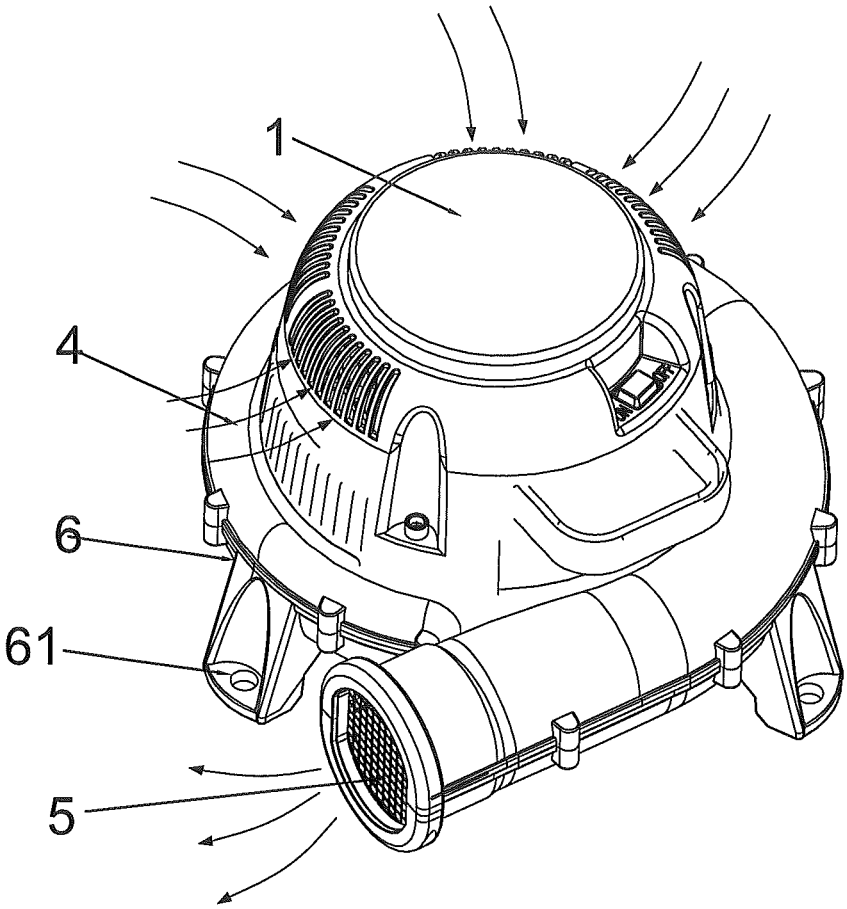
FIG. 1 is a perspective view of a blower according to the present invention.
Figure 2:
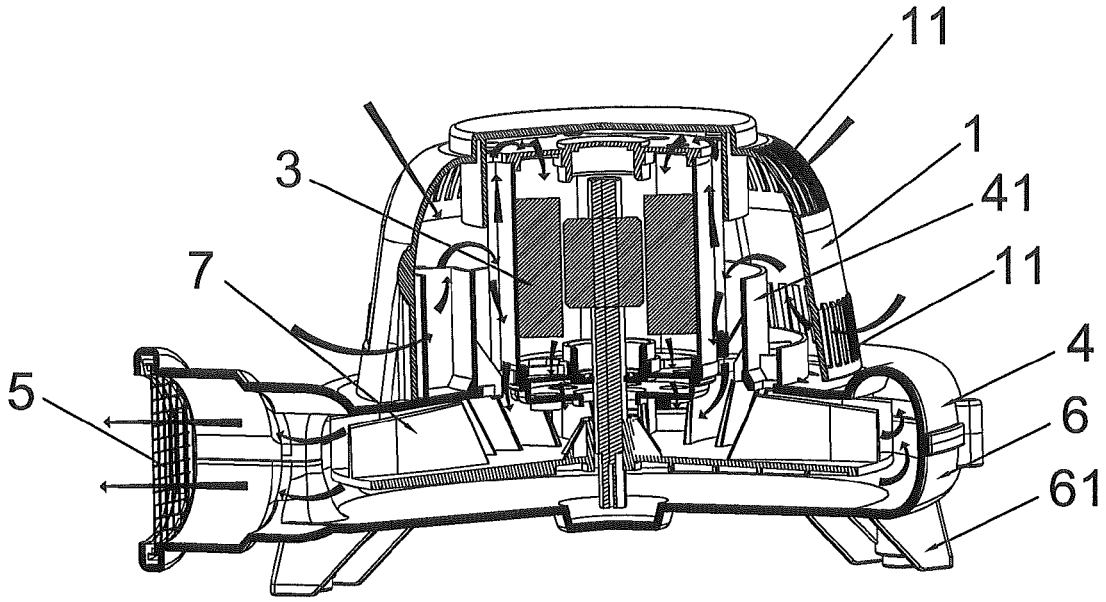
FIG. 2 is a view showing internal structures and air flow directions according to Embodiment 1 of the present invention.
Figure 3:
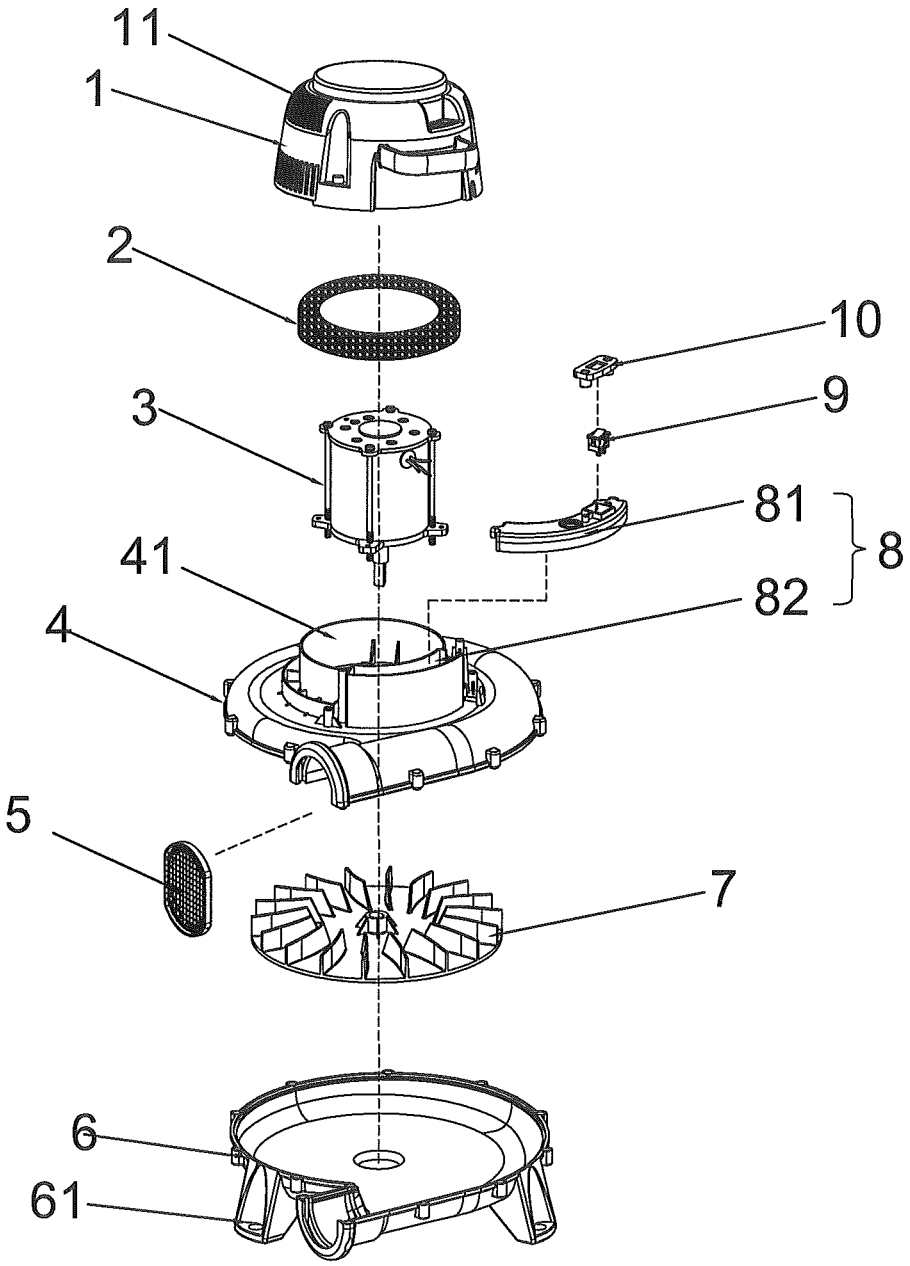
FIG. 3 is an exploded view of the blower according to Embodiment 1 of the present invention.

As shown in FIGS. 1, 2 and 3, a blower according to the present invention comprises a snail-shaped base 6, a snail-shaped cover 4, blades 7 and a motor 3, wherein the snail-shaped base 6 and the snail-shaped cover 4 form a exhaust channel, a spout net 5 is provided at an outlet of the exhaust channel, the blades 7 are horizontally provided in the exhaust channel, an integrally formed motor mounting chamber 41 is disposed on the snail-shaped cover 4 above the blades, a motor cover 1 is provided over the motor mounting chamber 41, the motor mounting chamber 41 and the motor cover 1 form an air intake channel, the motor 3 is vertically disposed in the air intake channel and connected to the blades 7 below, that is, the motor 3 is mounted in a space formed by the motor mounting chamber 41 and the motor cover 1 and connected to the blades 7 below via a motor shaft, thereby providing power for the blades 7.

Figure 4:
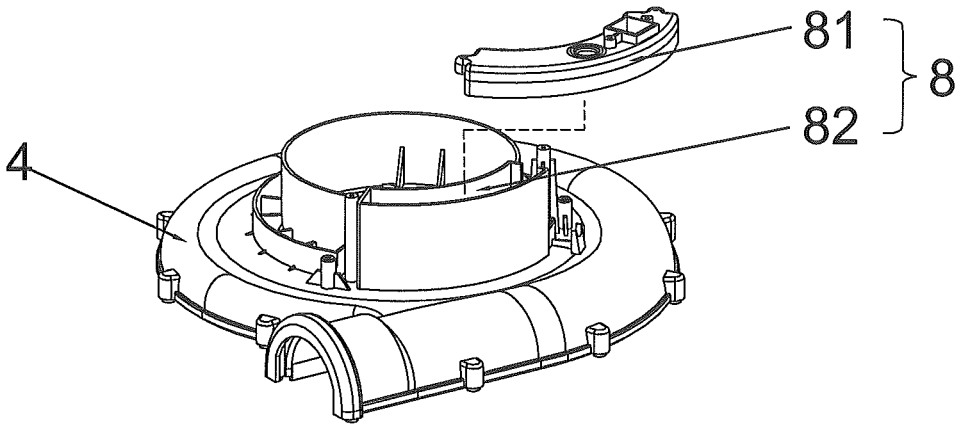
FIG. 4 is an exploded view of the capacitor junction box according to Embodiment 1 of the present invention.
Figure 5:
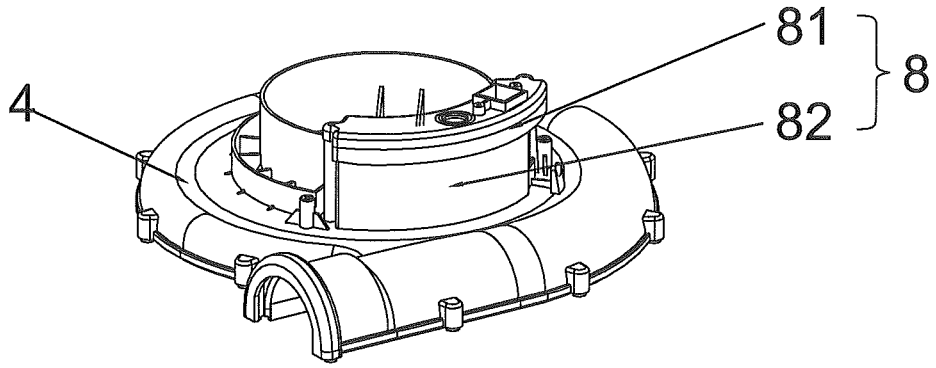
FIG. 5 is a view showing an assembled capacitor junction box according to Embodiment 1 of the present invention.

Furthermore, a plurality of slit-shaped air intake ports 11 are provided on a sidewall of the motor cover 1. In order to improve waterproof performance, a ring of waterproof rib is provided in the motor cover 1, an annular waterproof sponge 2 is mounted on the waterproof rib, and a water baffle is disposed between the motor 3 and the blades 7. As shown in FIG. 3, on the snail-shaped cover 4 are provided a sealed capacitor junction box 8, a switch 9 and a switch press plate 10. As shown in FIGS. 4 and 5, the capacitor junction box 8 is formed by sealingly engaging a capacitor junction cavity 82 with a capacitor junction lid 81. The switch 9 is provided on the above capacitor junction lid, and a waterproof seal switch sleeve is provided between the switch 9 and the capacitor junction lid 81. On the bottom of the snail-shaped base 6 are provided at least three leg supports 61 which enable the blower to operate more stably.

As shown in FIG. 2, when the motor above the blades 7 brings the blades 7 into rotation, air is sucked in through the slit-shaped air intake ports 11 on the motor cover 1 above the motor, whereupon air flows through the motor 3 and meanwhile cools the motor during air intake, then air enters the exhaust channel due to a rotational suction force of the blades, and finally air is discharged out of the outlet of the exhaust channel by a centrifugal force of the blades 7.

Embodiment 2

As shown in FIGS. 6-18, the blower according to the present invention comprises a snail-shaped base 6, a snail-shaped cover 4, blades 7 and a motor 3, wherein the snail-shaped base 6 and the snail-shaped cover 4 form a exhaust channel, a spout net 5 is provided at an outlet of the exhaust channel, the blades 7 are horizontally provided in the exhaust channel, an integrally formed motor mounting chamber 41 is disposed on the snail-shaped cover 4 above the blades, and at least four motor mounting legs 42 are disposed in the motor mounting chamber 41. A motor cover 1 is provided over the motor mounting chamber 41, the motor mounting chamber 41 and the motor cover 1 form an air intake channel, the motor 3 is vertically disposed in the air intake channel and connected to the blades 7 below, that is, the motor 3 is mounted in a space formed by the motor mounting chamber 41 and the motor cover 1 and connected to the blades 7 below via a motor shaft, thereby providing power for the blades 7.

The motor 3 is provided with a front end cover 31 and a rear end cover 32, and a plurality of ventilation apertures are provided on the front end cover 31 and the rear end cover 32.

Figure 8:
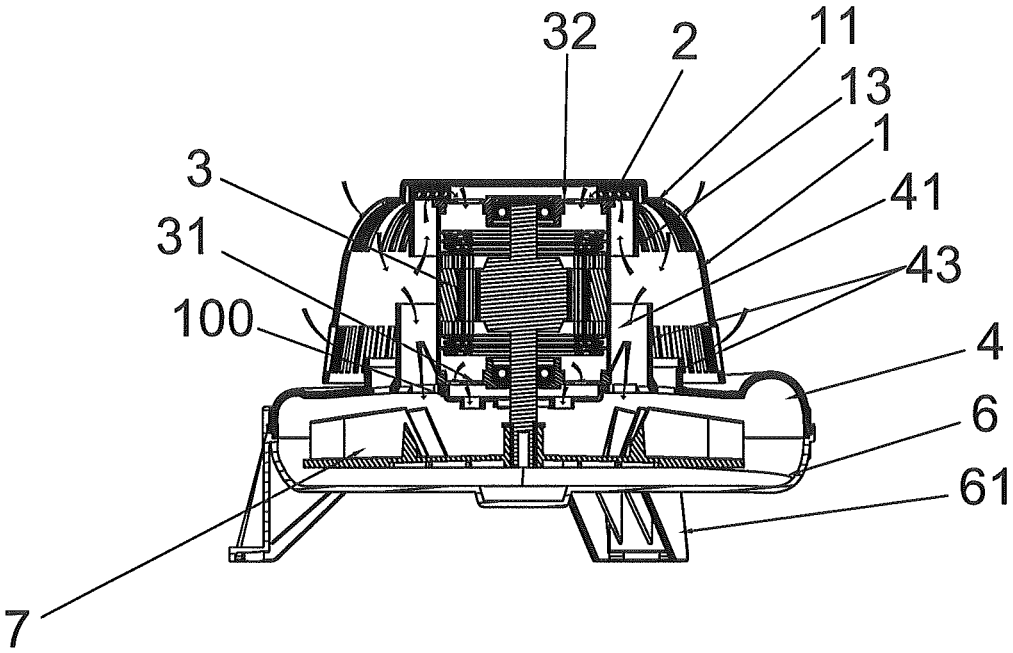
FIG. 8 is a schematic view of a first arrangement of an annular waterproof sponge according to Embodiment 2 of the present invention.
Figure 9:
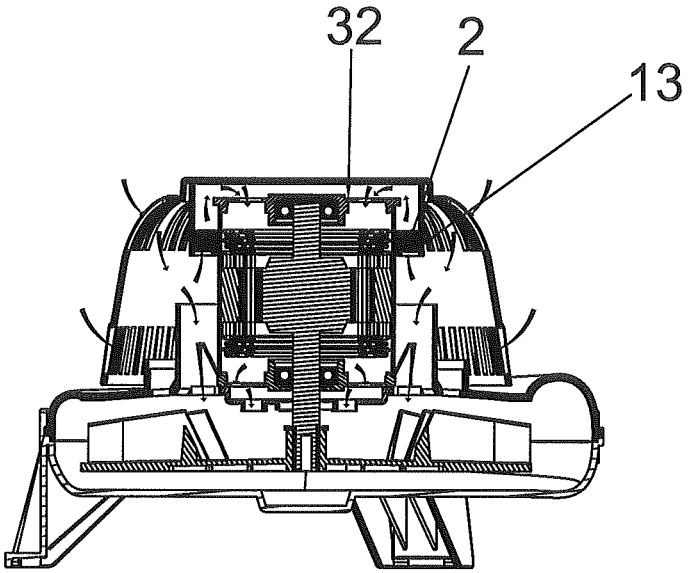
FIG. 9 is a schematic view of a second arrangement of an annular waterproof sponge according to Embodiment 2 of the present invention.
Figure 11:
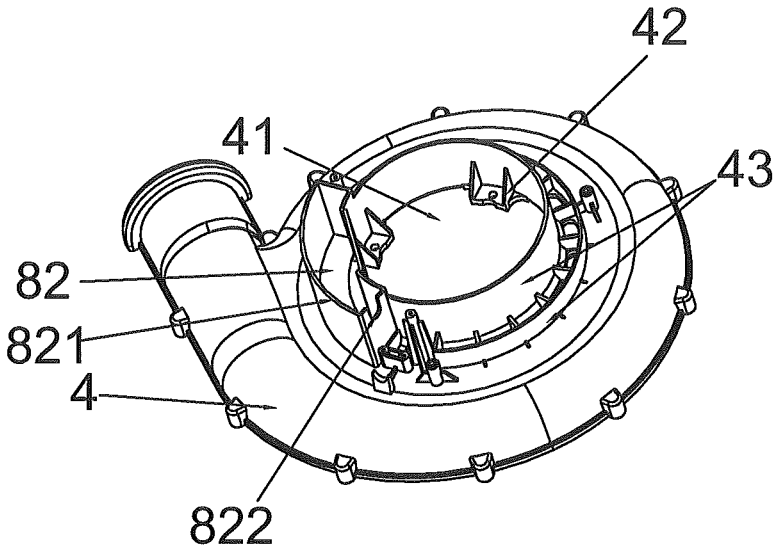
FIG. 11 is a front view of the snail-shaped cover of Embodiment 2 of the present invention.
Figure 14:
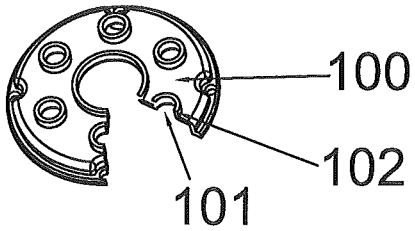
FIG. 14 is a cross sectional view of a water baffle according to Embodiment 2 of the present invention.
Figure 15:
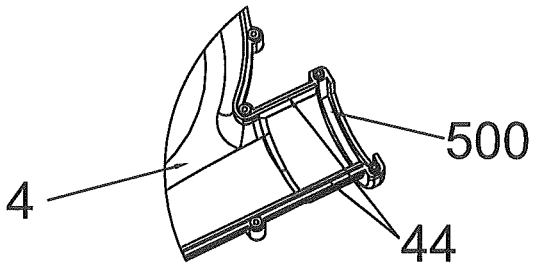
FIG. 15 is a partial view of the rear side of the snail-shaped cover of Embodiment 2 of the present invention.

Furthermore, a plurality of air intake ports 11 are provided on a sidewall of the motor cover 1 and constitute an inlet of air intake channel. A waterproof ring wall 43 is provided at the outer circumference of the motor mounting chamber 41 (as shown in FIG. 11) to keep part of vapor out of the motor. In order to improve the waterproof performance, a ring of waterproof rib 13 and an annular waterproof sponge 2 are provided in the motor cover 1, and the annular waterproof sponge 2 is disposed between the motor rear end cover 32 and the waterproof rib 13 as shown in FIG. 8 or disposed between the motor sidewall and the waterproof rib 13 as shown in FIG. 9 to filter vapor and avoid vapor from being sucked in the motor 3. As shown in FIGS. 6-9, a water baffle 100 is provided between the motor 3 and the blades 7, and specifically, the water baffle is disposed below and abuts closely against the motor front end cover 31. As shown in FIG. 14, the water baffle 100 is provided with ventilation openings 101 and ventilation opening rings 102. The above construction resists against water on the following principle: after the motor 3 drives the blades 7 and sucks water droplet-entraining gas inside through the slit-shaped air intake ports 11 on the motor cover, when the gas passes through the waterproof rib 13 on the motor cover 1 and the waterproof ring wall 43 at the outer circumference of the motor mounting chamber, part of the water droplets in the gas are intercepted by the waterproof rib 13 and the waterproof ring wall 43, and part of the remaining water droplet-entraining gas enters the interior of the motor via the motor rear end cover 32 to cool the motor 3, whereupon the water droplets-entraining gas is sucked in the annular waterproof sponge 2 and the droplets are further intercepted by the annular waterproof sponge 2 to prevent them from entering the motor 3; meanwhile, another part of the above-mentioned remaining water droplet-entraining gas is sucked via the outside of the motor downwardly into the exhaust channel, whereupon the water droplets are further intercepted by the ventilation opening rings 102 on the water baffle 100. In this way, the motor 3 is dually protected against water so that the motor is effectively protected and the service life of the motor is prolonged.

Figure 6:
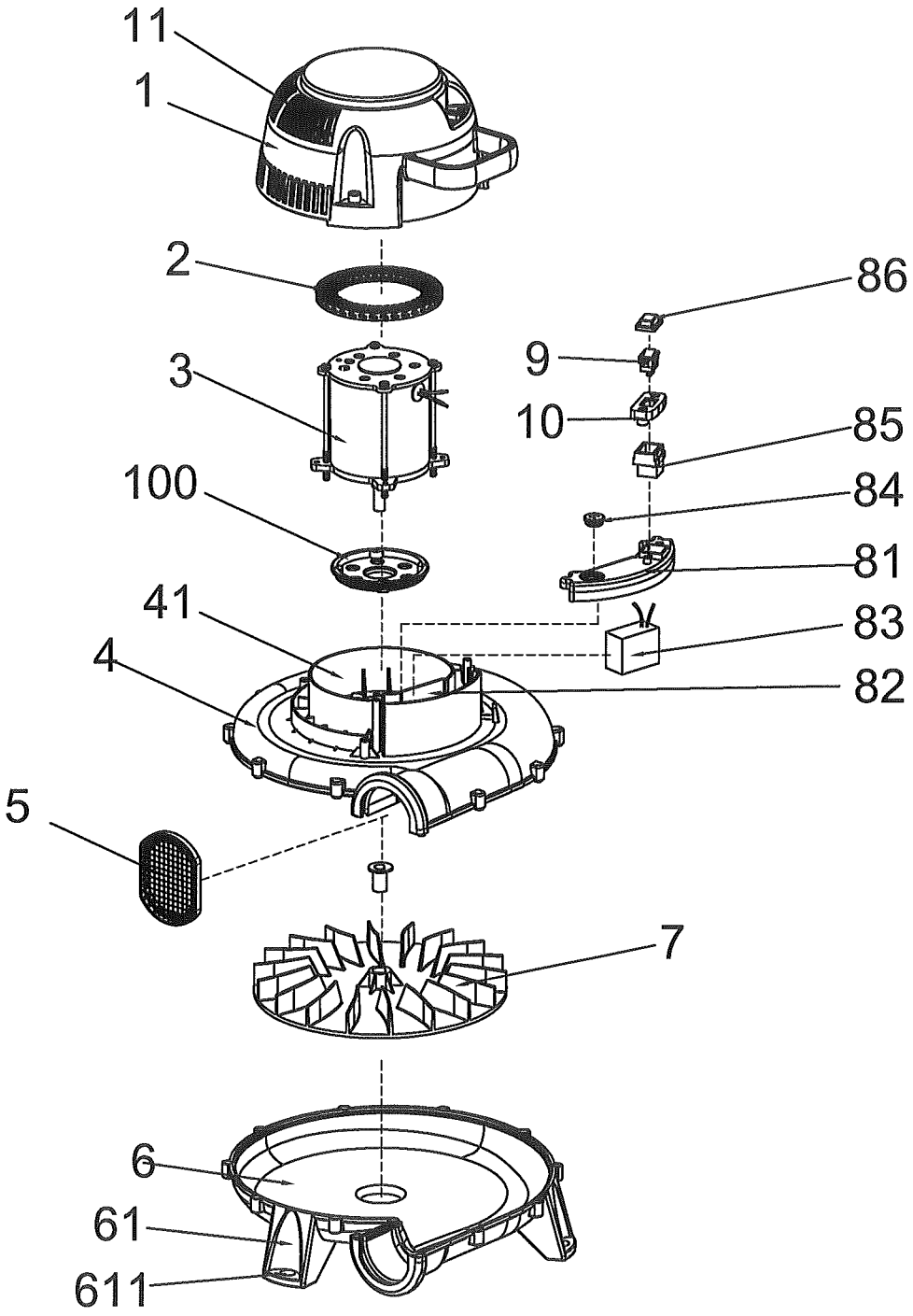
FIG. 6 is an exploded view of the blower according to Embodiment 2 of the present invention.
Figure 7:
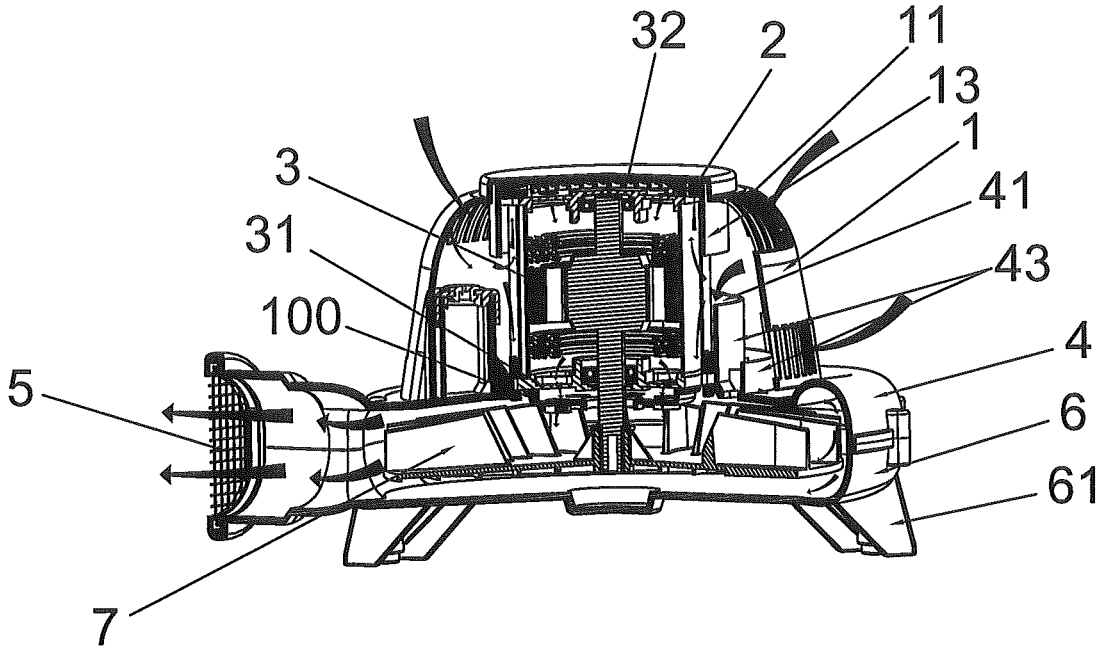
FIG. 7 is a view showing internal structures and air flow directions according to Embodiment 2 of the present invention.
Figure 10:
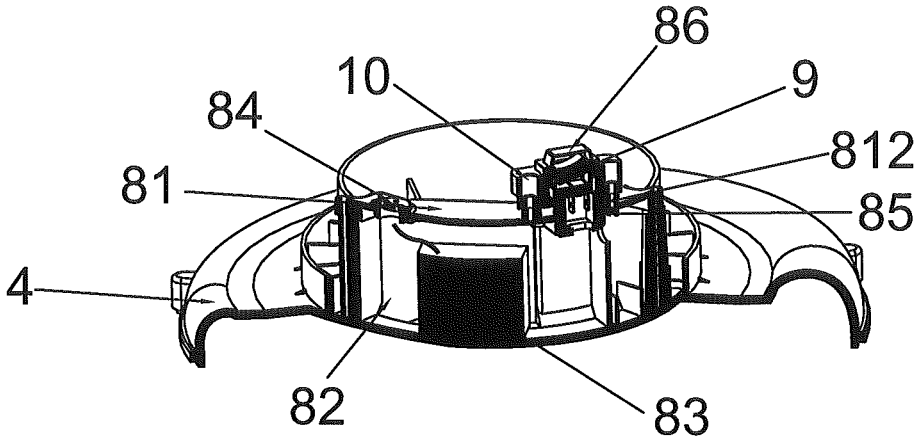
FIG. 10 is a cross sectional view of the capacitor junction box according to Embodiment 2 of the present invention.
Figure 12:
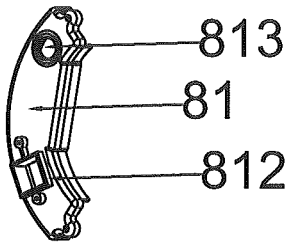
FIG. 12 is a front view of a capacitor junction lid according to Embodiment 2 of the present invention.
Figure 13:
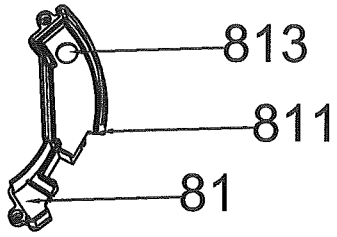
FIG. 13 is a rear view of the capacitor junction lid according to Embodiment 2 of the present invention.

As shown in FIG. 6, on the snail-shaped cover 4 is provided a sealed capacitor junction box 8 which is formed by sealingly engaging a capacitor junction cavity 82 with a capacitor junction lid 81. As shown in FIGS. 11, 12 and 13, an upper edge of the wall of the capacitor junction cavity is a sealing rib 821, a sealing slot 811 is provided at a corresponding position of the capacitor junction lid 81, the sealing rib 821 and the sealing slot 811 are in sealing engagement to allow the capacitor junction cavity 82 to sealingly engage the capacitor junction lid 81. As shown in FIG. 6, a switch 9 is disposed on the capacitor junction lid 81 and a switch guard cover 86 is disposed above the switch 9. As shown in FIGS. 6 and 10, the switch 9 is mounted on the switch press plate 10, a waterproof seal switch sleeve 85 is provided between the switch 9 and the switch press plate 10 and the capacitor junction lid 81, and a switch sleeve sealing rib 812 is provided at a position of the capacitor junction lid 81 corresponding to the position for mounting the waterproof seal switch sleeve. Furthermore, as shown in FIG. 10, a capacitor 83 is disposed in the above capacitor junction box 8; a power line notch 822 is provided on a sidewall of the capacitor junction cavity 82 (as shown in FIG. 11); the capacitor junction lid 81 is provided with a motor lead wire through hole 813 around which a power line sleeve 84 is provided (as shown in FIGS. 6, 10 and 12) to reinforce resistance against water and which is sealed by using a sealing glue after being mounted.

Figure 16:
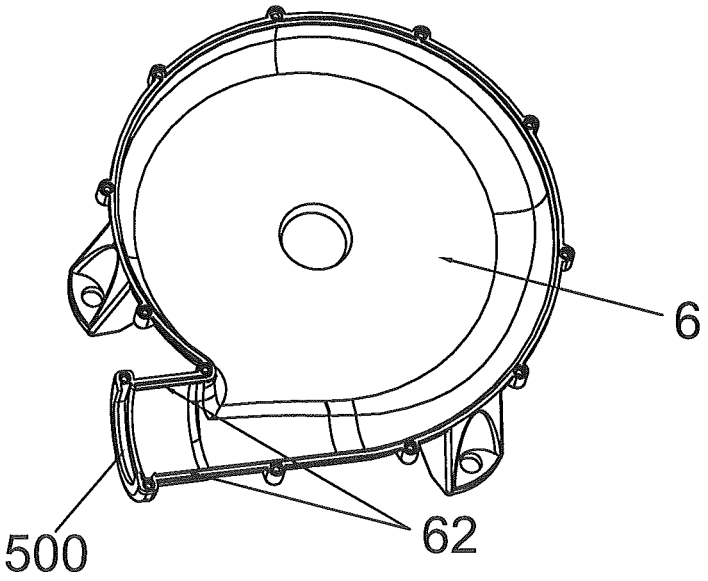
FIG. 16 is a schematic view of a snail-shaped base of Embodiment 2 of the present invention.

Furthermore, as shown in FIGS. 6 and 16, on the bottom of the snail-shaped base 6 are provided at least three leg supports 61. At least one ground nail mounting hole 611 is provided on each of the leg supports 61 so that when the blower is placed on a lawn, it can be fastened to the ground by fastening a ground nail through the ground nail mounting hole 611. The leg supports 61 are provided to make the blower operate more stably and meanwhile can prevent the possible damage by the submerging of the accumulated water on the ground.

Figure 17:
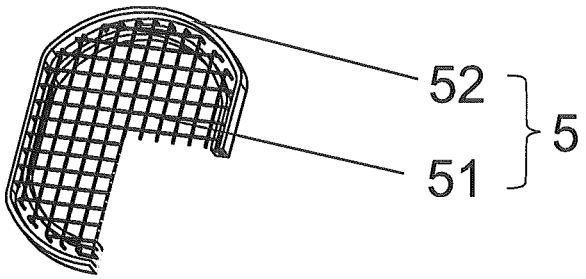
FIG. 17 is a cross sectional view of a spout net according to Embodiment 2 of the present invention.
Figure 18:
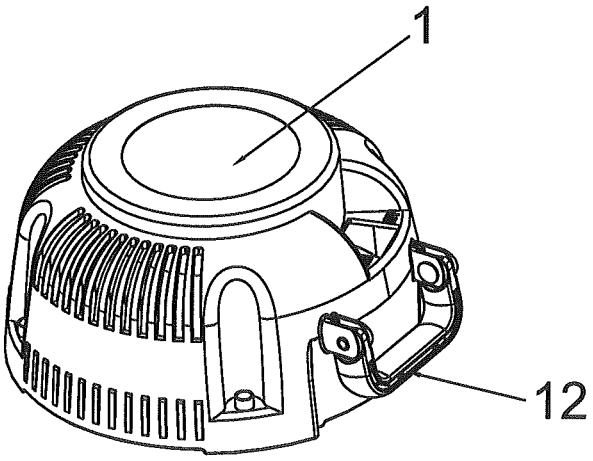
FIG. 18 is a schematic view of a portable handle on the motor cover according to Embodiment 2 of the present invention.

Again, as shown in FIG. 16, a spigot slot 62 is provided on the snail-shaped base 6, and a spigot flange 44 is provided on the snail-shaped cover 4. When the snail-shaped base 6 is mounted with the snail-shaped cover 4, the spigot slot 62 cooperates with the spigot flange 44 and they are fastened together by bolts extending through bolt mounting holes. At an outlet of the exhaust channel formed by the snail-shaped base 6 and the snail-shaped cover 4 is provided an elliptical spout net mounting groove 500 for mounting the spout nets. Furthermore, as shown in FIG. 17, the spout net 5 is a plastic-steel spout net including a stainless steel net 51 and a spout net sleeve 52, wherein a folded edge of the stainless steel net 51 is inserted into a fixing groove of the spout net sleeve 52 and then epoxy resin is filled in the fixing groove to cure as a whole. The spout net is mainly characterized by resistance against rust and burs to avoid scratching of hand upon mounting.

Furthermore, as shown in FIG. 6, the motor cover 1 is provided with a handle 12 for portability purpose. To further save space, the handle 12 is a foldable handle 12 which is a mounting base of the motor cover 1 by a hinge shaft.

The working principle of the present invention is: when the motor 3 is energized to drive the blades 7, air stream is sucked from the external into the air intake channel through the slit-shaped ports 11 on the motor cover 1, and then sucked in the exhaust channel respectively from the side of the motor and (the motor rear end cover 32, through the interior of the motor, and out of the front end cover 31), and finally gas is discharged out of the exhaust channel by the centrifugal force generated by the blades 7.

The blower according to the present invention is structurally scientific and concise; the blades are horizontally disposed so that the center of gravity of the whole machine is in balance such that the blower is not liable to overturn and safe in use; the motor is vertically disposed above the blades so that air sucked through the air intake ports of the motor cover can function to cool the motor, effectively reduce the temperature rise of the motor, improve the efficiency of the motor, save energy and pursue for environmental protection and prolong the service life of the motor. The motor is disposed above the blades and a distance from the ground surface is effectively ensured, thereby solving the problem that the motor is submerged by water. Additionally, the sealing design of the capacitor junction box and protection against water at both ends of the motor provide a good waterproof performance. The blower according to the present invention is a novel blower which is balanced in terms of center of gravity, energy-saving, environment-friendly, advantageously waterproof and particularly suitable for outdoor use.

What is claimed is:

1. A blower, comprising:

a snail-shaped base, a snail-shaped cover, a plurality of blades, and a motor, the snail-shaped base and the snail-shaped cover forming an exhaust channel;

wherein the plurality of blades are horizontally provided in the exhaust channel, the snail-shaped cover above the plurality of blades is provided with an air intake channel formed by a motor mounting chamber and a motor cover, and the motor is vertically disposed in the air intake channel and connected to the plurality of blades therebelow;

wherein a plurality of slit-shaped air intake ports are provided on a sidewall of the motor cover, and the motor cover is provided with a ring of waterproof rib.

2. The blower according to claim 1, wherein the blower further comprises an annular waterproof sponge mounted on the waterproof rib.

3. The blower according to claim 1, wherein on the bottom of the snail-shaped base are provided at least three leg supports.

4. The blower according to claim 1, wherein a water baffle is provided between the motor and the plurality of blades.

5. The blower according to claim 1, wherein on the snail-shaped cover are provided a sealed capacitor junction box which is formed by sealingly engaging a capacitor junction cavity with a capacitor junction lid.

6. The blower according to claim 5, wherein a switch is provided on the capacitor junction lid, and a waterproof seal switch sleeve is provided between the switch and the capacitor junction lid.

7. A blower, comprising:

a snail-shaped base, a snail-shaped cover, a plurality of blades, and a motor, the snail-shaped base and the snail-shaped cover forming an exhaust channel;

wherein the plurality of blades are horizontally provided in the exhaust channel, the snail-shaped cover above the plurality of blades is provided with an air intake channel formed by a motor mounting chamber and a motor cover, and the motor is vertically disposed in the air intake channel and connected to the plurality of blades therebelow;

wherein a water baffle is provided between the motor and the plurality of blades.

8. A blower, comprising:

a snail-shaped base, a snail-shaped cover, a plurality of blades, and a motor, the snail-shaped base and the snail-shaped cover forming an exhaust channel;

wherein the plurality of blades are horizontally provided in the exhaust channel, the snail-shaped cover above the plurality of blades is provided with an air intake channel formed by a motor mounting chamber and a motor cover, and the motor is vertically disposed in the air intake channel and connected to the plurality of blades therebelow;

wherein the motor cover is provided with a ring of waterproof rib;

wherein the blower further comprises an annular waterproof sponge mounted on the waterproof rib;

wherein a water baffle is provided between the motor and the plurality of blades;

wherein a waterproof ring wall is provided at an outer circumference of the motor mounting chamber.

* * * * *